US010260260B2

(12) United States Patent
Youn et al.

(10) Patent No.: US 10,260,260 B2
(45) Date of Patent: Apr. 16, 2019

(54) DOOR CHECKER APPARATUS FOR VEHICLE

(71) Applicants: Hyundai Motor Company, Seoul (KR); Kia Motors Corporation, Seoul (KR); Iljin Co., Ltd., Gyeongju-si (KR)

(72) Inventors: Sun Kyoung Youn, Seoul (KR); Jae Sung Park, Gyeongju-si (KR)

(73) Assignees: Hyundai Motor Company, Seoul (KR); Kia Motors Corporation, Seoul (KR); Iljin Co., Ltd., Gyeongju-si (KR)

( * ) Notice: Subject to any disclaimer, the term of this patent is extended or adjusted under 35 U.S.C. 154(b) by 0 days.

(21) Appl. No.: 15/788,627

(22) Filed: Oct. 19, 2017

(65) Prior Publication Data

US 2019/0010741 A1 Jan. 10, 2019

(30) Foreign Application Priority Data

Jul. 5, 2017 (KR) ..... 10-2017-0085390

(51) Int. Cl.
*E05C 17/22* (2006.01)
*E05F 5/02* (2006.01)
*E05C 17/20* (2006.01)

(52) U.S. Cl.
CPC ..... *E05C 17/203* (2013.01); *E05Y 2900/531* (2013.01)

(58) Field of Classification Search
CPC ... Y10T 16/61; Y10T 16/629; Y10T 16/6295; Y10T 292/285; Y10T 292/286; Y10T 292/304; E05C 17/025; E05C 17/04; E05C 17/12; E05C 17/20; E05C 17/203; E05C 17/206; E05C 17/22; E05C 17/26; E05C 17/24; E05C 17/28; E05C 17/18; E05F 5/025; E05F 5/08; E05F 5/06; E05F 5/12; E05F 1/1008; E05Y 2900/531; B60J 5/04
See application file for complete search history.

(56) References Cited

U.S. PATENT DOCUMENTS 5,474,344 A * 12/1995 Lee ..... E05C 17/203 16/86 C
6,370,733 B2 * 4/2002 Paton ..... E05C 17/203 16/82
6,446,305 B1 * 9/2002 Kneeland ..... E05C 17/206 16/49
7,240,399 B2 7/2007 Murayama et al.
(Continued)

FOREIGN PATENT DOCUMENTS

JP 2001-200672 A 7/2001
KR 10-2011-0089472 A 8/2011
KR 10-2013-0042407 A 4/2013

*Primary Examiner* — Chuck Y Mah
(74) *Attorney, Agent, or Firm* — Morgan, Lewis & Bockius LLP

(57) ABSTRACT

A door checker apparatus for a vehicle configured for realizing an optimized operation of opening or closing, of a door when the door is opened or dosed, may include a checker arm having a first end portion connected to the vehicle body and a second end portion connected to the door, a slider provided to be movable with respect to the checker arm, an elastic member configured to elastically support the slider, and a checker case accommodating the slider and the elastic member and provided to be movable with respect to the checker arm, wherein the checker case is injection-molded with a plastic material.

10 Claims, 9 Drawing Sheets

(56) References Cited

U.S. PATENT DOCUMENTS

| | | | | |
|---|---|---|---|---|
| 2002/0135100 | A1* | 9/2002 | Audisio | E05C 17/203 264/275 |
| 2003/0037411 | A1* | 2/2003 | Seo | E05C 17/206 16/86 C |
| 2003/0101537 | A1* | 6/2003 | Matsuki | E05C 17/206 16/85 |
| 2003/0159243 | A1* | 8/2003 | Audisio | E05C 17/203 16/82 |
| 2006/0207059 | A1* | 9/2006 | Van Den Heuvel | E05C 17/203 16/86 B |
| 2006/0267354 | A1* | 11/2006 | Petrus Van Den Heuvel | E05C 17/203 292/262 |
| 2009/0072552 | A1* | 3/2009 | Kitayama | E05C 17/203 292/262 |
| 2009/0217592 | A1* | 9/2009 | Tashima | E05C 17/206 49/148 |
| 2012/0246871 | A1* | 10/2012 | Settsu | E05F 5/025 16/83 |
| 2013/0031747 | A1* | 2/2013 | Gobart | E05D 11/1028 16/82 |

* cited by examiner

DOOR CHECKER APPARATUS FOR VEHICLE

CROSS-REFERENCE TO RELATED APPLICATION(S)

The present application claims priority to Korean Patent Application No. 10-2017-0085390 filed on Jul. 5, 2017, the entire contents of which is incorporated herein for all purposes by this reference.

BACKGROUND OF THE INVENTION

Field of the Invention

The present invention relates to a door checker device for a vehicle capable of realizing an optimized operation of opening and closing of a door when the door is opened and closed.

Description of Related Art

In a vehicle, a door checker defines a maximum opening range of a door and keeps the door in an open state. The door checker prevents the door from being opened further when the door is fully open, thus ensuring the safe use of the door. The door checker keeps the door in the open state and prevents it from being open or closed by the wind or its own weight.

Generally, the door checker includes a checker arm extending toward the door when the door checker is rotatably coupled to a vehicle body and having a curved surface formed at an upper portion and a lower portion of the checker arm, a checker housing mounted on the door to slidably support the checker arm, a pressing member provided in the checker housing to press the curved surface of the checker arm, and a stopper provided at the end of the checker arm.

The door checker is provided with components for controlling the opening and closing of the door in the checker housing made of a steel material, which leads to problems of deterioration in assemblability, weight increase, and cost increase due to an increase in the number of components.

BRIEF SUMMARY

Various aspects of the present invention are directed to providing a door checker apparatus for a vehicle which is configured for realizing an optimized operation of opening or closing of a door when the door is opened or closed.

Various aspects of the present invention are directed to providing a door checker apparatus for a vehicle which is configured for improving the operation feeling and merchantability of a door when the door is opened or closed by optimizing the configuration of the door checker apparatus.

Various aspects of the present invention are directed to providing a door checker apparatus for a vehicle which is configured for improving productivity, and reducing the cost and vehicle weight by simplifying the door checker apparatus.

Additional aspects of the disclosure will be set forth in part in the description which follows and, in part, will be apparent from the description.

In accordance with an aspect of the present invention, a door checker apparatus for a vehicle is disposed between a vehicle body and a door, and includes a checker arm having a first end portion connected to the vehicle body and a second end portion connected to the door, a slider provided to be movable with respect to the checker arm, an elastic member configured to elastically support the slider, and a checker case accommodating the slider and the elastic member and provided to be movable with respect to the checker arm. The checker case is injection-molded with a plastic material.

The checker case may include a base and a cover coupled to the base to form a receiving space in which the slider and the elastic member are received. At least one of the base and the cover may be formed by plastic injection insert molding.

The base may be coupled to the cover by a snap-fit connection.

The checker arm may include a curved surface in which an upper surface of the checker arm protrudes.

The checker arm may include convex portions and concave portions symmetrically formed on an upper surface and a lower surface of the checker arm, respectively. The convex portions and concave portions may be alternately disposed.

The slider and the elastic member may be provided on an upper surface and a lower surface of the checker arm, respectively.

The slider may include a guide having a shape corresponding to the concave portions, an elastic member installation groove formed inside the slider to receive the elastic member, and a grease pocket configured to store fluid to lubricate between the checker arm and the slider.

The checker case may further include an elastic member guide configured to guide the installation of the elastic member.

In accordance with another aspect of the present invention, a door checker apparatus for a vehicle includes a checker arm having a first end portion coupled to a vehicle body and a second end portion coupled to a door, a pair of sliders movably supported on the checker arm, a pair of elastic members provided to elastically support the sliders, and a checker case mounted on the door to be movable with respect to the checker arm. The checker case includes a base and a cover coupled to the base to define a receiving space in which the slider and the elastic member are received. At least one of the base and the cover is formed by plastic injection insert molding.

The checker arm may include a curved surface protruding upward.

The cover may be formed by plastic injection insert molding.

The base may be coupled to the cover by a snap-fit connection.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
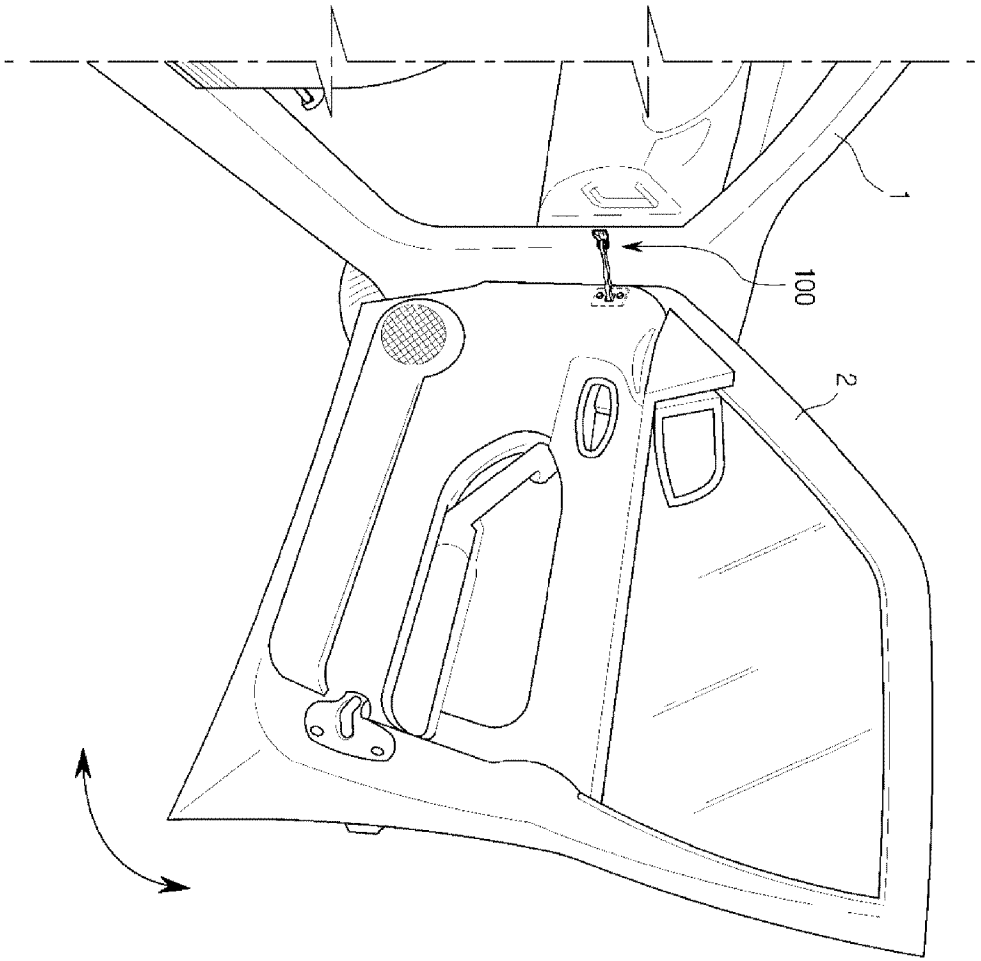
FIG. 1 is a view illustrating a door checker apparatus applied to a vehicle according to an exemplary embodiment of the present invention.

It may be understood that the appended drawings are not necessarily to scale, presenting a somewhat simplified representation of various features illustrative of the basic principles of the invention. The specific design features of the present invention as included herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Configurations illustrated in the exemplary embodiments and the drawings described in the present specification are only the exemplary embodiments of the present invention, and thus it is to be understood that various modified examples, which may replace the embodiments and the drawings described in the present specification, are possible when filing the present application.

Like reference numerals or symbols denoted in the drawings of the present specification indicate elements or components that perform substantially the same functions.

The terms used in the present specification are for describing embodiments and not for limiting or restricting the present invention. It is to be understood that the singular forms "a," "an," and "the" include plural referents unless the context clearly dictates otherwise. It will be understood that when the terms "includes," "comprises," "including," and/or "comprising" are used in the present specification, they specify the presence of stated features, figures, steps, components, or combinations thereof, but do not preclude the presence or addition of one or more other features, figures, steps, components, members, or combinations thereof.

It will be understood that, although the terms first, second, etc. may be used herein to describe various components, these components should not be limited by these terms. These terms are only used to distinguish one component from another. For example, a first component could be termed a second component, and, similarly, a second component could be termed a first component, without departing from the scope of the present invention. As used herein, the term "and/or" includes any and all combinations of one or more of the associated listed items.

Meanwhile, in the following description, the terms "front direction," "rear direction," "upper portion," "lower portion," etc. are defined based on the drawings, and do not intend to limit the shapes and locations of individual components.

In the following description, a vehicle includes various machines that transport humans, goods, or animals from a departure point to a destination. For example, the vehicle may be an automobile to travel on roads or rails, a ship to travel by sea or river, or a plane to fly in the sky using the action of air.

Also, a vehicle traveling on roads or rails may move in a predetermined direction by rotation of at least one rotating wheel. The vehicle may include a three- or four-wheeled vehicle, construction machinery, a two-wheeled vehicle, a prime mover bicycle, a bicycle, and a train travelling along rails.

Hereinafter, exemplary embodiments according to an exemplary embodiment of the present invention will be described in detail with reference to the accompanying drawings.

Figure 2:
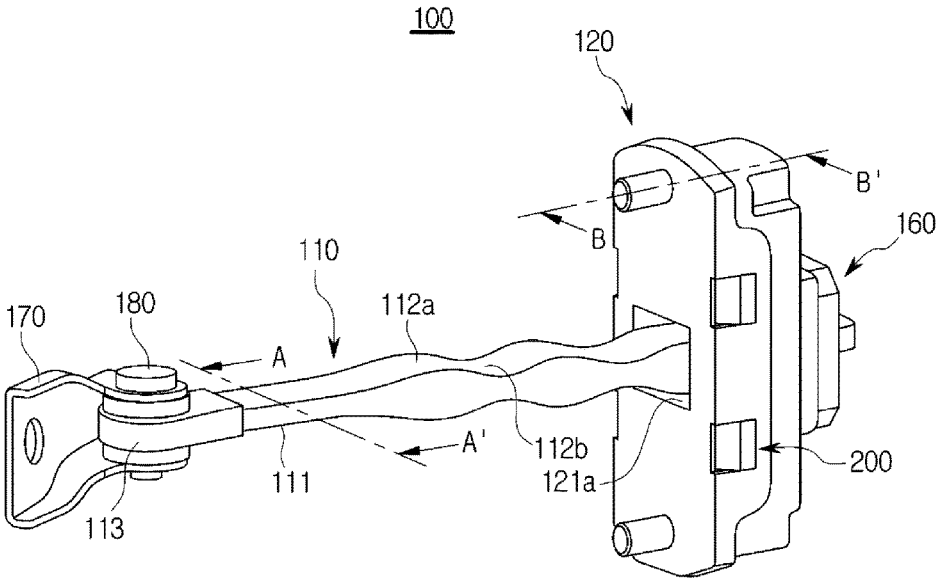
FIG. 2 is a perspective view illustrating a door checker apparatus for a vehicle according to an exemplary embodiment of the present invention.

FIG. 1 is a view illustrating a door checker apparatus applied to a vehicle according to an exemplary embodiment of the present invention and FIG. 2 is a perspective view illustrating a door checker apparatus for a vehicle according to an exemplary embodiment of the present invention.

Referring to FIG. 1 and FIG. 2, a door 2 of a vehicle is disposed at a vehicle body 1 to be laterally rotatable. A door checker apparatus 100 for the vehicle defines the maximum opening range of the door 2 by connecting the door 2 and the vehicle body 1, and maintains the door 2 in a stopped state through a damping function when the door 2 is opened so that the door 2 is not opened further or closed.

The door checker apparatus 100 may include a checker arm 110 extending toward the door 2 when the door checker apparatus 100 is rotatably coupled to the vehicle body 1 and having curved surfaces formed at an upper portion and a lower portion of the checker arm 110, a checker case 120 mounted on the door 2 to slidably support the checker arm 110, and a stopper 160 provided at the end portion of the checker arm 110.

Figure 3:
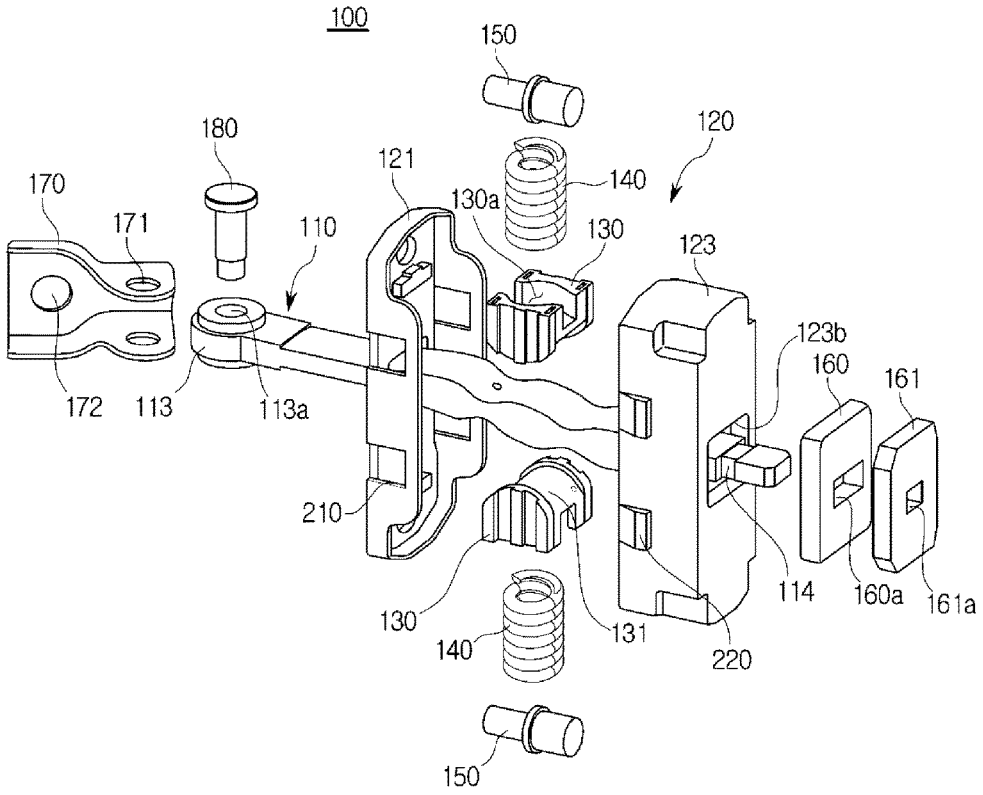
FIG. 3 is an exploded perspective view illustrating a door checker apparatus for a vehicle according to an exemplary embodiment of the present invention.
Figure 4:
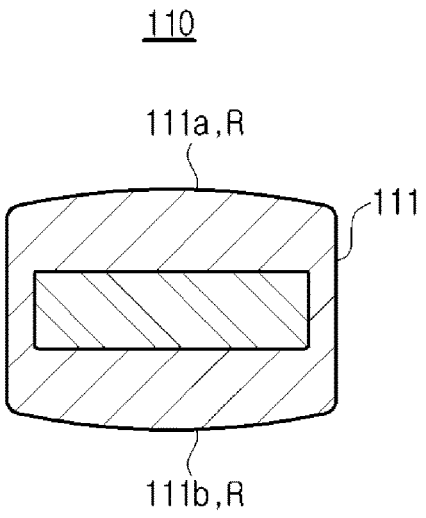
FIG. 4 is a cross-sectional view taken along line A-A' in FIG. 2, illustrating a checker arm according to an exemplary embodiment of the present invention.
Figure 5:
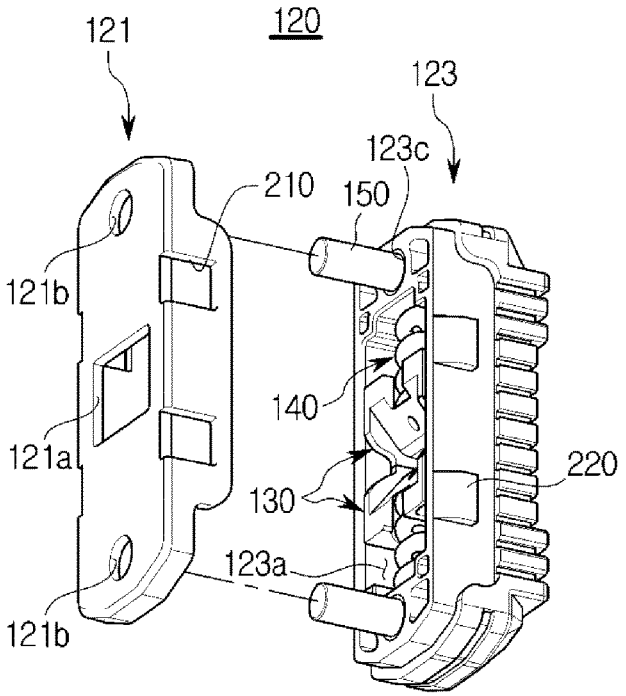
FIG. 5 is a partially exploded perspective view illustrating a checker case of a door checker apparatus according to an exemplary embodiment of the present invention.
Figure 6:
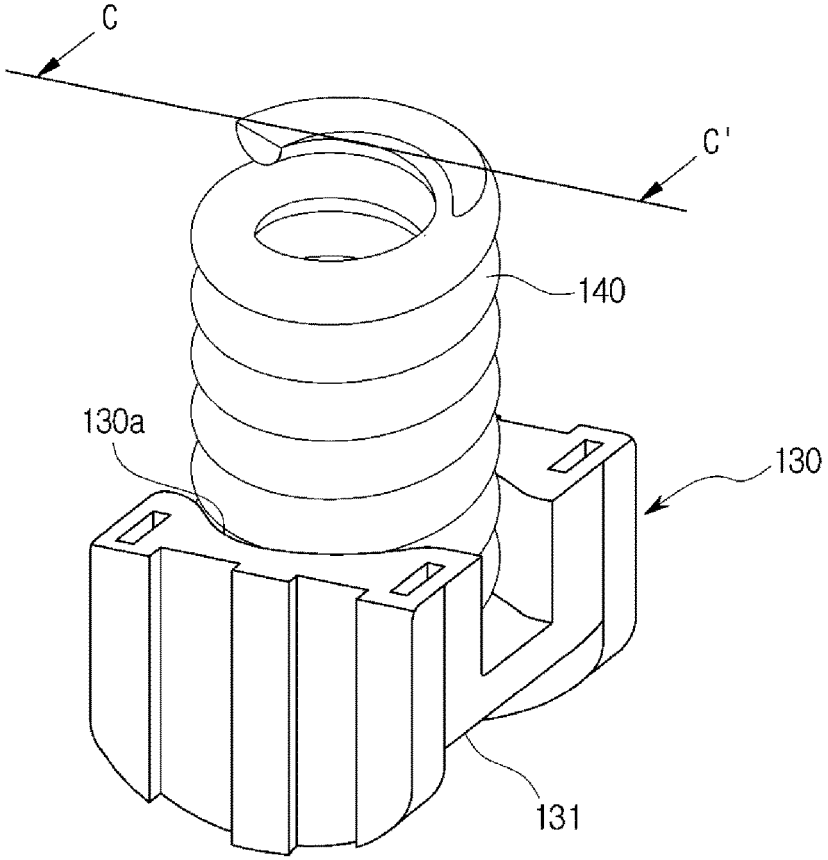
FIG. 6 is a view illustrating a state in which a slider is coupled to an elastic member in a door checker apparatus according to an exemplary embodiment of the present invention.
Figure 7:
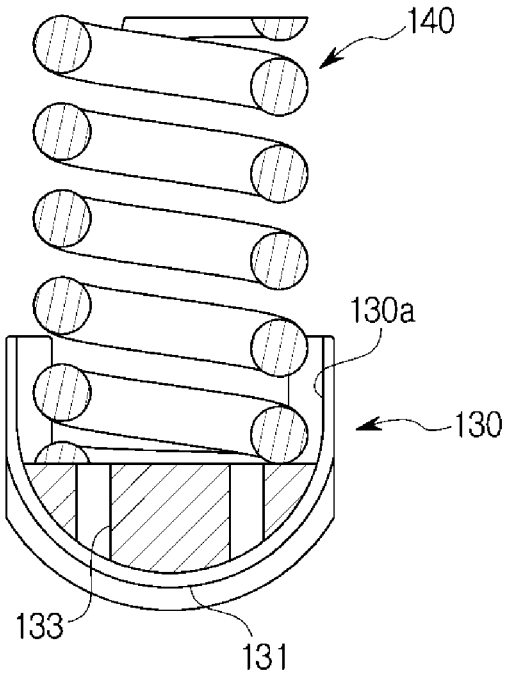
FIG. 7 is a cross-sectional view taken along line C-C' in FIG. 7, illustrating a grease pocket according to an exemplary embodiment of the present invention.
Figure 8:
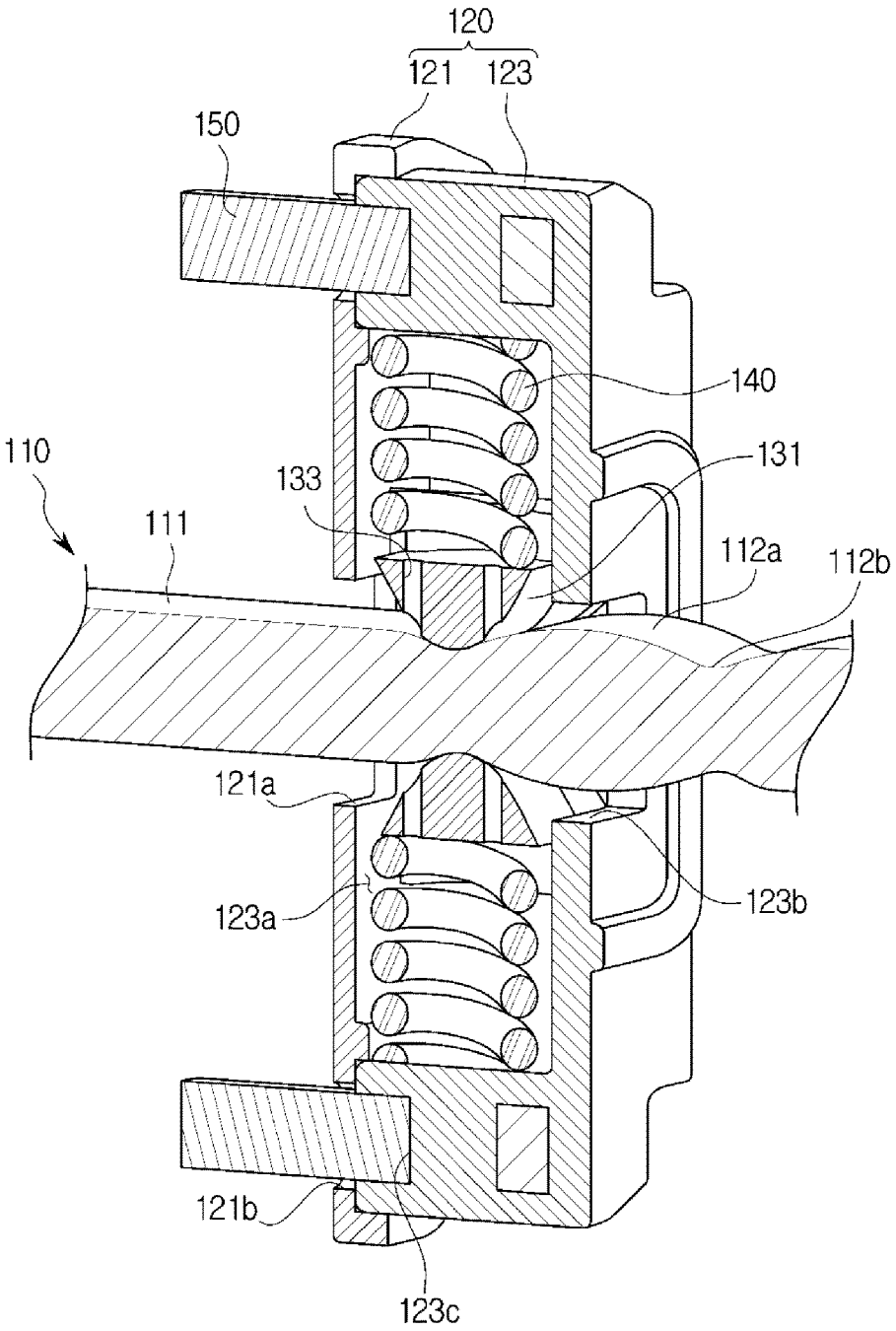
FIG. 8 is a cross-sectional view taken along line B-B' in FIG. 2, illustrating a door checker apparatus according to an exemplary embodiment of the present invention.
Figure 9:
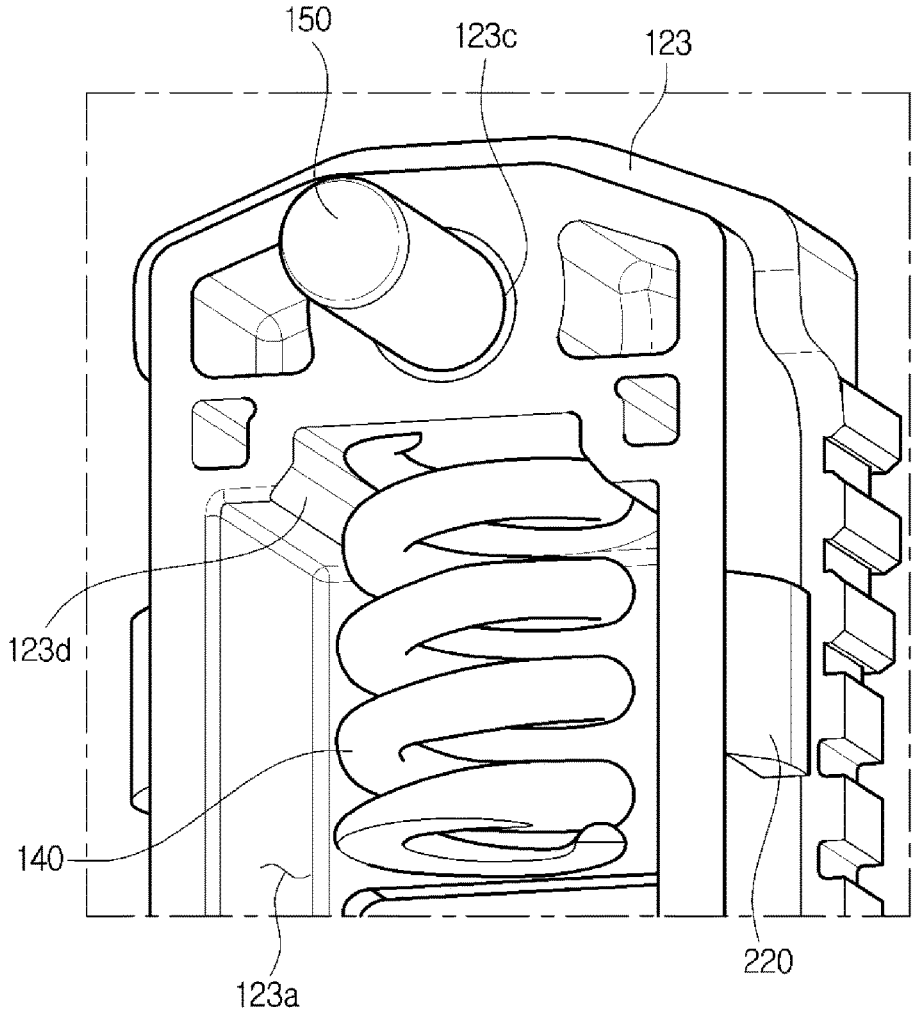
FIG. 9 is a view illustrating an elastic member mounted on a checker case according to an exemplary embodiment of the present invention.

FIG. 3 is an exploded perspective view illustrating a door checker apparatus for a vehicle according to an exemplary embodiment of the present invention, FIG. 4 is a cross-sectional view taken along line A-A' in FIG. 2, illustrating a checker arm according to an exemplary embodiment of the present invention, FIG. 5 is a partially exploded perspective view illustrating a checker case of a door checker apparatus according to an exemplary embodiment of the present invention, FIG. 6 is a view illustrating a state in which a slider is coupled to an elastic member in a door checker apparatus according to an exemplary embodiment of the present invention, FIG. 7 is a cross-sectional view taken along line C-C' in FIG. 7, illustrating a grease pocket according to an exemplary embodiment of the present invention, FIG. 8 is a cross-sectional view taken along line B-B' in FIG. 2, illustrating a door checker apparatus according to an exemplary embodiment of the present invention, and FIG. 9 is a view illustrating an elastic member mounted on a checker case according to an exemplary embodiment of the present invention.

As illustrated in FIGS. 3 to 9, the door checker apparatus 100 may include a bracket 170 fixed to the vehicle body 1, the checker arm 110 having one side rotatably connected to the bracket 170 and extending toward the door 2, the checker case 120 slidably coupled to the checker arm 110, and the stopper 160 mounted on a free end portion of the checker arm 110 to define a maximum opening angle of the door 2.

The bracket 170 fixed to the vehicle body 1 may be provided to be hinged to the checker arm 110, The bracket 170 may include a fixing hole 172 provided to be fixed to the vehicle body 1 and a hinge hole 171 formed to be rotatably connected to the checker arm 110. The fixing hole 172 of the bracket 170 may be fixed to the vehicle body 1 by a fixing member including a bolt.

The checker arm 110 may be formed in a rod shape. At one end portion of the checker arm 110, a first connecting portion 113 to be connected to the vehicle body 1 may be provided. At the other end portion of the checker arm 110, a stopper connecting portion 114 to be connected to the stopper 160 is formed.

The first connecting portion 113 may include a first connection hole 113*a* to which a hinge pin 180 is coupled. The first connection hole 113*a* of the checker arm 110 is formed to correspond to the hinge hole 171 of the bracket 170.

The hinge pin 180 is coupled through the hinge hole 171 of the bracket 170 and the first connection hole 113*a* of the checker arm 110. One side of the checker arm 110 may be rotatably coupled to the bracket 170 by the hinge pin 180. One side of the checker arm 110 may be rotatably coupled to the vehicle body 1 by the bracket 170.

The checker arm 110 includes a rod-shaped checker arm body 111. The checker arm body 111 may include an upper surface 111*a*, a lower surface 111*b* corresponding to the upper surface 111*a*, and side surfaces. The checker arm 110 includes a plurality of convex portions 112*a* and a plurality of concave portions 112*b* for controlling the opening or closing of the door 2. The convex portions 112*a* and the concave portions 112*b* may be formed on an upper portion and a lower portion of the checker arm body 111, respectively. The convex portions 112*a* and the concave portions 112*b* may be alternately disposed. The convex portions 112*a* and the concave portions 112*b* may be symmetrically formed on the upper surface 111*a* and the lower surface 111*b*, respectively. The convex portions 112*a* and the concave portions 112*b* may be formed on at least one side of the checker arm 110 formed to be long in a longitudinal direction thereof. The convex portions 112*a* and the concave portions 112*b* may not be formed on a side closer to the bracket 170 of the checker arm 110 but may be formed on a side closer to the stopper 160 of the checker arm 110. The number of the convex portions 112*a* and the concave portions 112*b* is for providing stability when the door 2 is opened and the door 2 may be stopped by the number of the concave portions 112*b*.

The upper surface 111*a* of the checker arm body 111 may include a curved surface R. At least one surface of the checker arm body 111 may include the curved surface R. The upper surface 111*a* of the checker arm 110 may include the curved surface R protruding upward. The upper surface 111*a* having the curved surface R protruding upward may prevent accumulation of dust and foreign matter on the checker arm 110. The curved surface R of the checker arm 110 may reduce the generation of noise due to dust and foreign matter.

The stopper 160 provided on the stopper connecting portion 114 of the checker arm 110 stops the opening of the door 2 while contacting the checker case 120 when the door 2 is fully opened. The checker case 120 slidably provided on the checker arm 110 stops moving while contacting the stopper 160 and thus the opening of the door 2 is stopped.

The stopper 160 may further include a stopper plate 161. The stopper 160 and the stopper plate 161 may be provided with checker arm coupling holes 160*a* and 161*a* to be coupled to the checker arm 110, respectively. Each of the checker arm coupling holes 160*a* and 161*a* may be formed in a size and shape corresponding to the stopper connecting portion 114 of the checker arm 110. It may be preferable that the end portion of the checker arm 110 is formed to be greater than the checker arm coupling hole 160*a*. of the stopper 160 and the checker arm coupling hole 161*a* of the stopper plate 161.

The checker case 120 slidably provided on the checker arm 110 may include a base 121 and a cover 123 coupled to the base 121. The checker case 120 may include a receiving space 123*a* in which a slider 130 and an elastic member 140 are accommodated.

The base 121 is formed substantially in a plate shape, and a first through hole 121*a* is formed such that the checker arm 110 is disposed at the center of the base 121. The first through hole 121*a* may have a shape corresponding to the checker arm 110 or may be formed greater than the checker arm 110 so that the checker case 120 is slidably movable with respect to the checker arm 110. On an upper side and a lower side of the base 121, a second through hole 121*b* is formed for mounting a door mount 150, which will be described later. The door mount 150 is provided to fix the checker case 120 to the door 2. The door mount 150 may include a fixing member including a bolt.

A first coupling portion 210 is formed at the base 121 to be coupled with the cover 123 by a snap-fit connection. The first coupling portion 210 may include holes, grooves, slits, or the like.

The cover 123 may be formed in a hexahedron shape with one side opened. The receiving space 123*a* may be formed inside the cover 123. A checker arm through hole 123*b* is formed on a rear surface of the cover 123 such that the checker arm 110 passes through the center thereof. The checker arm through hole 123*b* is formed at a position corresponding to the first through hole 121*a* of the base 121. The checker arm through hole 123*b* may be preferably formed in a size and shape corresponding to the first through hole 121*a*. The checker case 120 may be slidably movable with respect to the checker arm 110 by the checker arm through hole 123*b* and the first through hole 121*a*.

The cover 123 may be provided with a door mount installation groove 123*c* formed to correspond to the second through hole 121*b* of the base 121. The door mount installation groove 123*c* is formed so that the door mount 150 is fixed. The door mount installation groove 123*c* may be formed on an upper side and a lower side of the cover 123, respectively.

The cover 123 may include a second coupling portion 220 protruding from at least one side of the cover 123 to be coupled with the first coupling portion 210 of the base 121 by a snap-fit connection. The second coupling portion 220 may include a protrusion or a hook. In the exemplary embodiment of the present invention, the first and second coupling portions are disposed at the upper and lower portions of the left and right sides of the base 121 and the cover 123, respectively, so that four coupling portions are shown as being coupled. However, the spirit of the present invention is not limited thereto. For example, the shape and the number of the coupling portions may be variously changed.

Therefore, the base 121 may be coupled to the cover 123 by a snap-fit connection in a state where the door mount 150 is fixed to the door mount installation groove 123*c*. The door mount 150 may be coupled through the second through hole 121*b* of the base 121.

Meanwhile, the checker case 120 may be injection-molded with a plastic material. The base 121 of the checker case 120 may be injection-molded with a plastic material. The cover 123 of the checker case 120 may be formed by plastic injection insert molding. The checker case 120 formed by injection molding of the plastic material may reduce the weight of the door checker apparatus 100.

The slider 130 and the elastic member 140 accommodated in the receiving space 123*a* inside the checker case 120 may be provided in pairs on the upper and lower sides of the checker atm 110, respectively.

The slider 130 is in contact with the checker arm 110 and provided to be movable with respect to the checker arm 110. The slider 130 is provided to move in contact with the checker arm 110 when the checker case 120 is moved by the door 2. The elastic member 140 is provided to elastically support the slider 130.

The slider 130 includes a guide 131 configured to move in contact with the checker arm 110 and an elastic member installation groove 130*a* in which the elastic member 140 is disposed. The guide 131 may be formed on at least one surface of external surfaces of the slider 130. The guide 131 may be formed in a round shape to facilitate the movement of the slider 130.

The slider 130 may be formed of a mixed material of polyoxymethylene (POM) and aramid. The slider 130 may include a grease pocket 133 formed for lubrication with the checker arm 110. The grease pocket 133 is provided to smoothly move the slider 130 by applying a lubricant between the grease pocket 133 and the checker arm 110. At least one grease pocket 133 may be formed inside the slider 130. The grease pocket 133 may be formed so that the internal to the slider 130 communicates with the outside of the slider 130. The grease pocket 133 extends in a vertical direction and is connected to the guide 131. The lubricant of the grease pocket 133 may improve the lubrication between the slider 130 and the checker arm 110 through the guide 131. The lubricant of the grease pocket 133 may improve the operation of the elastic member 140 and reduce the noise.

The elastic member 140 is coupled to the elastic member installation groove 130*a* of the slider 130 and inserted into the receiving space 123*a* of the checker case 120.

An elastic member guide 123*d* for guiding the installation of the elastic member 140 is formed in the receiving space 123*a* of the checker case 120. The elastic member guides 123*d* are formed in an upper side and a lower side of the receiving space 123*a*, respectively. The elastic member guide 123*d* is provided such that one end portion of the elastic member is disposed in the receiving space 123*a* of the checker case 120. The elastic member guide 123*d* may guide the elastic member 140 to be accommodated in the checker case 120 at a predetermined position.

As is apparent from the above description, in accordance with the exemplary embodiments of the present invention, it may be possible to realize an optimized operation of opening or closing of the door when the door is opened or closed and to improve the operation feeling and merchantability of the door.

It may also be possible to reduce the weight of the door checker apparatus by forming the checker case by plastic injection molding.

It may also be possible to reduce the number of parts and the assembling process by simplifying the door checker apparatus, reducing costs and improving productivity.

For convenience in explanation and accurate definition in the appended claims, the terms "upper", "lower", "internal", "outer", "up", "down", "upper", "lower", "upwards", "downwards", "front", "rear", "back", "inside", "outside", "inwardly", "outwardly", "internal", "external", "internal", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A door checker apparatus for a vehicle, the door checker apparatus disposed between a vehicle body and a door, and comprising:

a checker arm having a first end portion connected to the vehicle body and a second end portion connected to the door;

at least one slider provided to be movable with respect to the checker arm;

an elastic member elastically supporting each slider; and a checker case accommodating the slider and the elastic member and provided to be movable with respect to the checker arm, wherein the checker case is injection-molded with a plastic material, wherein the checker arm includes convex potions and concave portions symmetrically formed on an upper surface and a lower surface of the checker arm, respectively, of which the convex portions and concave portions alternately disposed for slidably engaging said at least one slider, and wherein each slider includes a guide having a shape corresponding to the concave portions, an elastic member installation groove formed inside the slider to receive the elastic member, and a grease pocket formed inside the slider, and said grease pocket communicating with the outside of the slider and storing fluid therein to lubricate between the checker arm and the slider.

2. The door checker apparatus according to claim 1, wherein the checker case includes a base and a cover coupled to the base to form a receiving space in which the slider and the elastic member are received, and wherein at least one of the base and the cover is formed by plastic injection insert molding.

3. The door checker apparatus according to claim 2, wherein the base is coupled to the cover by a snap-fit connection.

4. The door checker apparatus according to claim 2, wherein the checker case further includes an elastic member guide configured to guide the installation of the elastic member.

5. The door checker apparatus according to claim 1, wherein the checker arm includes a curved surface in which the upper surface of the checker arm is protrudingly formed.

6. The door checker apparatus according to claim 1, wherein said at least one slider includes two sliders, and the two sliders are respectively disposed on the upper surface and the lower face of the checker arm.

7. A door checker apparatus for a vehicle, the door checker apparatus comprising:

a checker arm having a first end portion coupled to a vehicle body and a second end portion coupled to a door;

a pair of sliders movably supported on the checker arm;

a pair of elastic members provided to elastically support the respective sliders; and a checker case mounted on the door to be movable with respect to the checker arm, wherein the checker case includes a base and a cover coupled to the base to define a receiving space in which the sliders and the elastic members are received, and wherein at least one of the base and the cover is formed by plastic injection insert molding, wherein the checker arm includes convex portions and concave portions symmetrically formed on an upper surface and a lower surface of the checker arm, respectively, of which the convex portions and concave portions alternately disposed, and wherein each slider includes a guide having a shape corresponding to the concave portions, an elastic member installation groove formed inside the slider to receive the elastic member, and a grease pocket formed inside the slider, and said grease pocket communicating with the outside of the slider and storing fluid therein to lubricate between the checker arm and the slider.

8. The door checker apparatus according to claim 7, wherein the checker arm includes a curved surface protruding upward.

9. The door checker apparatus according to claim 8, wherein the cover is formed by plastic injection insert molding.

10. The door checker apparatus according to claim 8, wherein the base is coupled to the cover by a snap-fit connection.

* * * * *